US007998285B2

(12) United States Patent
Beguinot et al.

(10) Patent No.: US 7,998,285 B2
(45) Date of Patent: Aug. 16, 2011

(54) ABRASION-RESISTANT STEEL PLATE

(75) Inventors: Jean Beguinot, Le Creusot (FR); Jean-Georges Brisson, Le Creusot (FR)

(73) Assignee: Industeel Creusot, Puteaux (FR)

( * ) Notice: Subject to any disclaimer, the term of this patent is extended or adjusted under 35 U.S.C. 154(b) by 446 days.

(21) Appl. No.: 12/141,327

(22) Filed: Jun. 18, 2008

(65) Prior Publication Data

US 2008/0253921 A1 Oct. 16, 2008

Related U.S. Application Data

(62) Division of application No. 10/535,176, filed as application No. PCT/FR2003/003357 on Nov. 13, 2003, now Pat. No. 7,462,251.

(30) Foreign Application Priority Data

Nov. 19, 2002 (FR) ..... 02 14425

(51) Int. Cl.
*C22C 38/14* (2006.01)
*C22C 38/02* (2006.01)
*C22C 38/06* (2006.01)
*C22C 38/12* (2006.01)

(52) U.S. Cl. ..... 148/328; 148/320; 148/332; 148/333; 148/334; 148/335; 148/336; 148/330; 420/109; 420/110; 420/121; 420/126; 420/128

(58) Field of Classification Search ..... 148/320, 148/328, 330–336; 420/104–110, 125, 126, 420/128
See application file for complete search history.

(56) References Cited

U.S. PATENT DOCUMENTS

| | | | |
|---|---|---|---|
| 5,645,794 | A | 7/1997 | Beguinot et al. |
| 5,695,576 | A | 12/1997 | Beguinot |
| 5,714,116 | A | 2/1998 | Beguinot et al. |
| 5,900,082 | A | 5/1999 | Hewitt |
| 6,251,198 | B1 | 6/2001 | Koo et al. |
| 6,423,426 | B1 | 7/2002 | Kobayashi et al. |

FOREIGN PATENT DOCUMENTS

| | | |
|---|---|---|
| EP | 1072689 | 1/2001 |
| JP | 10053814 | 2/1998 |
| JP | 10324952 | 12/1998 |
| JP | 2000199034 | 7/2000 |
| JP | 2000-239791 | 9/2000 |
| WO | 9840522 | 9/1998 |

OTHER PUBLICATIONS

Machine-English translation of Japanese patent 09-249935, Kushida Takahiro, Sep. 22, 1997.*

Computer-generated English translation of Japanese patent 10324952 Watari, Koji et al. Dec. 8, 1998.

* cited by examiner

*Primary Examiner* — Deborah Yee
(74) *Attorney, Agent, or Firm* — Sughrue Mion, PLLC

(57) ABSTRACT

The invention concerns a method for making an abrasion resistant steel plate having a chemical composition comprising: 0.1%≦C<0.23%; 0%≦Si≦2%; 0%≦Al≦2%; 0.5%≦Si+Al≦2%; 0%≦Mn≦2.5%; 0%≦Ni≦5%; 0%≦Cr≦5%; 0%≦Mo≦1%; 0%≦W≦2%; 0.05%≦Mo+W/2≦1%; 0%≦Cu≦1.5%; 0%≦B≦0.02%; 0%≦Ti≦0.67%; 0%≦Zr≦1.34%; 0.05%<Ti+Zr/2≦0.67%; 0%≦S≦0.15%; N<0.03%, optionally 0% to 1.5% of Cu; optionally Nb, Ta and V such that Nb/2+Ta/4+V≦0.5%; optionally Se, Te, Ca, Bi, Pb contents ≦0.1%; the rest being iron impurities. Additionally: 0.095%≦C*=C−Ti/4−Zr/8+7×N/8, Ti+Zr/2−7×N/2≧0.05% and 1.05×Mn+0.54×Ni+0.50×Cr+0.3×$(Mo+W/2)^{1/2}$+K>1.8, with K=1 if B≧0.0005% and K=0 if B<0.0005%. After austenitization, the method consists in: cooling at a speed >0.5° C./s between a temperature between $AC_3$ and T=800−270×C*−90×Mn−37×Ni−70×Cr−83×(Mo+W/2) and about T−50° C.; then cooling at a speed 0.1<Vr<1150×$ep^{-1.7}$ between T and 100° C., (ep=plate thickness in mm); cooling down to room temperature and optionally planishing. The invention also concerns the resulting plate.

6 Claims, No Drawings

ABRASION-RESISTANT STEEL PLATE

This is a divisional of application Ser. No. 10/535,176 filed Dec. 19, 2005, now U.S. Pat. No. 7,462,251 which is a §371 of PCT/FR2003/003357 filed Nov. 13, 2003, which are hereby incorporated by reference.

The present invention relates to an abrasion-resistant steel and its production method.

Steels for abrasion are known which have a hardness in the order of 400 Brinell and which contain approximately 0.15% of carbon, as well as manganese, nickel, chromium and molybdenum at contents of less than a few % in order to have sufficient quenchability. These steels are quenched so as to have a completely martensitic structure. They have the advantage of being relatively simple to use by means of welding, cutting or bending. However, they have the disadvantage of having limited abrasion resistance. Of course, it is known to increase the abrasion resistance by increasing the carbon content, and therefore the hardness. However, this method of operation has the disadvantage of impairing the suitability for use.

The object of the present invention is to overcome these disadvantages by providing an abrasion-resistant steel plate which, all things otherwise being equal, has abrasion resistance which is better than that of the known steels which have a hardness of 400 Brinell, whilst having a suitability for use which is comparable to that of those steels.

To this end, the invention relates to a method for producing a workpiece, and in particular a plate, of steel for abrasion whose chemical composition comprises, by weight:

$0.1\% \leqq C < 0.23\%$
$0\% \leqq Si \leqq 2\%$
$0\% \leqq Al \leqq 2\%$
$0.5\% \leqq Si+Al \leqq 2\%$
$0\% \leqq Mn \leqq 2.5\%$
$0\% \leqq Ni \leqq 5\%$
$0\% \leqq Cr \leqq 5\%$
$0\% \leqq Mo \leqq 1\%$
$0\% \leqq W \leqq 2\%$
$0.05\% \leqq Mo+W/2 \leqq 1\%$
$0\% \leqq Cu \leqq 1.5\%$
$0\% \leqq B \leqq 0.02\%$
$0\% \leqq Ti \leqq 0.67\%$
$0\% \leqq Zr \leqq 1.34\%$
$0.05\% < Ti+Zr/2 \leqq 0.67\%$
$0\% \leqq S \leqq 0.15\%$
$N < 0.03\%$ optionally at least one element selected from Nb, Ta and V at contents such that $Nb/2+Ta/4+V \leqq 0.5\%$, optionally at least one element selected from Se, Te, Ca, Bi, Pb at contents which are less than or equal to 0.1%, the balance being iron and impurities resulting from the production operation, the chemical composition further complying with the following relationships:

$$C^* = C - Ti/4 - Zr/8 + 7 \times N/8 \geqq 0.095\%$$

and:

$$Ti + Zr/2 - 7 \times N/2 \geqq 0.05\%$$

and:

$$1.05 \times Mn + 0.54 \times Ni + 0.50 \times Cr + 0.3 \times (Mo+W/2)^{1/2} + K > 1.8 \text{ or more advantageously } 2$$

with: $K=1$ if $B \geqq 0.0005\%$ and $K=0$ if $B < 0.0005\%$, the steel having a structure which is constituted by martensite or an admixture of martensite and auto-tempered bainite, the structure further containing carbides and from 5% to 20% of austenite.

According to the method, the workpiece or the plate is subjected to a thermal quenching processing operation which is carried out in the heat for forming in the hot state, such as rolling, or after austenitization by reheating in a furnace, which consists in:

cooling the plate at a mean cooling rate greater than 0.5° C./s between a temperature greater than $AC_3$ and a temperature of approximately from $T=800-270 \times C^*-90 \times Mn-37 \times Ni-70 \times Cr-83 \times (Mo+W/2)$ to T−50° C., the temperature being expressed in ° C. and the contents of C*, Mn, Ni, Cr, Mo and W being expressed as % by weight, then cooling the plate at a mean core cooling rate $Vr < 1150 \times ep^{-1.7}$ (in ° C./s) and greater than 0.1° C./s between the temperature T and 100° C., ep being the thickness of the plate expressed in mm, and cooling the plate as far as ambient temperature, planishing optionally being carried out.

Quenching may optionally be followed by tempering at a temperature of less than 350° C. and preferably less than 250° C.

The invention also relates to a plate which is obtained in particular using this method and whose flatness is characterized by a deflection less than or equal to 12 mm/m and preferably less than 5 mm/m, the steel having a structure which is constituted by from 5% to 20% of retained austenite, the remainder of the structure being martensitic or martensitic/bainitic and containing carbides. The thickness of the plate may be from 2 mm to 150 mm.

The hardness is preferably from 280 HB to 450 HB.

The invention will now be described in greater detail, but in a non-limiting manner, and illustrated with reference to examples.

In order to produce a plate according to the invention, a steel is produced whose chemical composition comprises, in % by weight:

more than 0.1% of carbon in order to have a sufficient level of hardness and in order to allow the formation of carbides, but less than 0.23%, and preferably less than 0.22% so that the suitability for welding and cutting is good.

From 0% to 0.67% of titanium and from 0% to 1.34% of zirconium, these contents having to be such that the total Ti+Zr/2 is greater than 0.05%, preferably greater than 0.1%, and, more advantageously still, greater than 0.2% so that the steel contains coarse titanium or zirconium carbides which increase the abrasion resistance. However, the total Ti+Zr/2 must remain less than 0.67% because above that level the steel would not contain sufficient free carbon for the hardness thereof to be sufficient. Furthermore, the content of Ti+Zr/2 will preferably be less than 0.50%, or more advantageously 0.40% or 0.30% if priority needs to be given to the toughness of the material.

From 0% (or trace levels) to 2% of silicon and from 0% (or trace levels) to 2% of aluminium, the total Si+Al being from 0.5% to 2% and preferably greater than 0.7%, or more advantageously, greater than 0.8%. These elements which are deoxidants, further have the effect of promoting the production of a metastable retained austenite which is heavily charged with carbon whose transformation into martensite is accompanied by a large expansion promoting the anchoring of the titanium carbides.

From 0% (or trace levels) to 2% or even 2.5% of manganese, from 0% (or trace levels) to 4% or even 5% of nickel and from 0% (or trace levels) to 4% or even 5% of chromium in order to obtain an adequate level of quenchability and to adjust the various mechanical characteristics or characteristics for use. Nickel in particular has an advantageous effect on the toughness, but that element is expensive. Chromium also forms fine carbides in martensite or bainite which promote the abrasion resistance.

From 0% (or trace levels) to 1% of molybdenum and from 0% (or trace levels) to 2% of tungsten, the total Mo+W/2 being from 0.05% to 1%, and preferably remaining less than 0.8%, or more advantageously, less than 0.5%. These elements increase the quenchability and form fine hardening carbides in the martensite or bainite, in particular by precipitation owing to auto-tempering during cooling. It is not necessary to exceed a content of 1% of molybdenum in order to obtain the desired effect in particular with regard to the precipitation of hardening carbides. Molybdenum may be completely or partially replaced with twice the weight of tungsten. Nevertheless, this substitution is not desirable in practice since it does not provide any advantage over molybdenum and is more expensive.

Optionally from 0% to 1.5% of copper. That element can bring about additional hardening without inhibiting the weldability. Above a level of 1.5%, it no longer has a significant effect, leads to hot-rolling difficulties and is unnecessarily expensive.

From 0% to 0.02% of boron. This element can be added optionally in order to increase the quenchability. In order to achieve this effect, the content of boron must preferably be greater than 0.0005%, or more advantageously, 0.001% and does not need to exceed substantially 0.01%.

Up to 0.15% of sulphur. That element is a residual which is generally limited to 0.005% or less, but the content thereof may be voluntarily increased in order to improve machinability. It should be noted that in the presence of sulphur, in order to prevent difficulties concerning transformation in the hot state, the content of manganese must be greater than seven times the content of sulphur.

Optionally at least one element selected from niobium, tantalum and vanadium at contents such that Nb/2+Ta/4+V remains less than 0.5% in order to form relatively coarse carbides which improve the resistance to abrasion. However, the carbides formed by those elements are less effective than the carbides formed by titanium or zirconium and, for that reason, they are optional and added in a limited quantity.

Optionally, one or more elements selected from selenium, tellurium, calcium, bismuth and lead, at contents of less than 0.1% each. Those elements are intended to improve machinability. It should be noted that, when steel contains Se and/or Te, the content of manganese must be such, taking into consideration the content of sulphur, that manganese selenides or tellurides can form.

The balance being iron and impurities resulting from the production operation. The impurities include in particular nitrogen, whose content depends on the production method but does not exceed 0.03% and generally remains less than 0.025%. Nitrogen may react with titanium or zirconium to form nitrides which must not be too coarse in order not to inhibit the toughness. In order to prevent the formation of coarse nitrides, titanium and zirconium may be added to liquid steel in a very progressive manner, for example, by placing in contact with the oxidized liquid steel an oxidized phase, such as a slag charged with titanium or zirconium oxides, then deoxidizing the liquid steel in order to cause the titanium or zirconium to diffuse slowly from the oxidized phase to the liquid steel.

Furthermore, in order to obtain satisfactory properties, the contents of carbon, titanium, zirconium and nitrogen are selected such that:

$$C^*=C-Ti/4-Zr/8+7\times N/8\geqq 0.095\%$$

and preferably $C^*\geqq 0.12\%$ in order to have an increased level of hardness and therefore better abrasion resistance. The quantity C* represents the content of free carbon after precipitation of the titanium and zirconium carbides, taking into consideration the formation of titanium and zirconium nitrides. That free carbon content C* must be greater than 0.095% in order to have a martensitic or martensitic/bainitic structure having sufficient hardness.

Taking into consideration the possible formation of titanium or zirconium nitrides, in order for the quantity of titanium or zirconium carbides to be sufficient, the contents of Ti, Zr and N must be such that:

$$Ti+Zr/2-7\times N/2\geqq 0.05\%$$

The chemical composition is further selected so that the quenchability of the steel is sufficient, taking into account the thickness of the plate which it is desirable to produce.

To this end, the chemical composition must comply with the relationship:

$$Tremp=1.05\times Mn+0.54\times Ni+0.50\times Cr+0.3\times(Mo+W/2)^{1/2}+K>1.8 \text{ or more advantageously } 2$$

with: K=1 if $B\geqq 0.0005\%$ and K=0 if $B<0.0005\%$.

Furthermore, and in order to obtain good abrasion resistance, the micrographic structure of the steel is constituted by martensite or bainite or an admixture of those two structures, and from 5% to 20% of retained austenite. That structure further comprises coarse titanium or zirconium carbides which are formed at high temperature and optionally niobium, tantalum or vanadium carbides. Owing to the method of production which will be described below, this structure is tempered, with the result that it also comprises molybdenum or tungsten carbides and optionally chromium carbides.

The inventors have established that the effectiveness of coarse carbides for improving abrasion resistance could be inhibited by the premature separation thereof and that that separation could be prevented by the presence of metastable austenite which is transformed under the effect of the abrasion phenomena. The transformation of the metastable austenite being brought about by expansion, that transformation in the abraded sub-layer increases the resistance to separation of the carbides and, in that manner, improves abrasion resistance.

Furthermore, the great hardness of the steel and the presence of embrittling titanium carbides make it necessary to limit insofar as possible the planishing operations. From that point of view, the inventors established that, by slowing down the cooling sufficiently in the range of bainitic/martensitic transformation, the residual deformations of the products are reduced, which allows planishing operations to be limited. The inventors have established that, by cooling down the workpiece or the plate at a mean core cooling rate $Vr<1150\times ep^{-1.7}$, (in this formula, ep is the thickness of the plate expressed in mm and the cooling rate is expressed in ° C./s), below a temperature $T=800-270\times C^*-90\times Mn-37\times Ni-70\times Cr-83\times(Mo+W/2)$, (expressed in ° C.), the residual stresses brought about by the phase changes were reduced. That cooling which is slowed down in the bainitic/martensitic range further has the advantage of bringing about auto-tempering which causes the formation of molybdenum, tungsten or chromium carbides and improves the wear resistance of the matrix which surrounds the coarse carbides.

In order to produce a very planar plate which has good abrasion resistance and good suitability for use, the steel is produced and cast in the form of a slab or bar. The slab or bar is hot-rolled in order to obtain a plate which is subjected to thermal processing which allows both the desired structure and a good surface evenness to be produced without further planishing or with limited planishing. The thermal processing may be carried out in the rolling heat or carried out subsequently, optionally after cold-planishing or planishing at a medium temperature.

In all cases, in order to carry out the thermal processing operation:

- the steel is heated above the point $AC_3$ in order to confer on it a structure which is completely austenitic but in which titanium or zirconium carbides remain,
- then it is cooled at a mean core cooling rate which is greater than the critical bainitic transformation velocity as far as a temperature of from approximately $T=800-270\times C^*-90\times Mn-37\times Ni-70\times Cr-83\times(Mo+W/2)$ to T−50° C., in order to prevent the formation of ferritic-perlitic constituents; to this end, it is generally sufficient to cool at a rate greater than 0.5° C./s,
- then, the plate is cooled, between the temperature which has been defined in this manner (that is to say, approximately from T to T−50° C.) and approximately 100° C., at a mean core cooling rate Vr which is less than $1150\times ep^{-1.7}$ and greater than 0.1° C./s in order to obtain the desired structure,
- and the plate is cooled as far as ambient temperature, preferably, but without being compulsory, at a slow rate.

Furthermore, it is possible to carry out a stress-relief processing operation, such as a tempering operation, at a temperature less than or equal to 350° C., and preferably less than 250° C.

Mean cooling rate is understood to be the cooling rate which is equal to the difference between the initial and final cooling temperatures divided by the cooling time between these two temperatures.

In this manner, a plate is obtained whose thickness can be from 2 mm to 150 mm and which has excellent surface evenness, characterized by a deflection of less than 3 mm per metre without planishing or with moderate planishing. The plate has a hardness of from 280 HB to 450 HB. That hardness depends principally on the content of free carbon $C^*=C-Ti/4-Zr/8+7\times N/8$. The hardness becomes greater as free carbon content becomes greater. The usability increases as the free carbon content decreases. With an equal content of free carbon, the resistance to abrasion becomes higher as the titanium content increases.

By way of example, steel plates 30 mm thick designated A, B, C and D according to the invention, E and F according to the prior art, and G and H given by way of comparison are considered. The chemical compositions of the steels, expressed in $10^{-3}$% by weight, as well as the hardness and a wear resistance index Rus, are summarized in Table 1.

TABLE 1

| | C | Si | Al | Mn | Ni | Cr | Mo | W | Ti | B | N | HB | Rus |
|---|---|---|---|---|---|---|---|---|---|---|---|---|---|
| A | 180 | 550 | 30 | 1750 | 200 | 1700 | 150 | — | 150 | 2 | 6 | 360 | 1.51 |
| B | 140 | 210 | 610 | 1450 | 650 | 1720 | 230 | 120 | 160 | 3 | 7 | 345 | 1.42 |
| C | 220 | 830 | 25 | 1250 | 220 | 1350 | 275 | | 350 | 2 | 5 | 360 | 2.03 |
| D | 158 | 780 | 35 | 1250 | 250 | 1340 | 260 | | 110 | 3 | 5 | 363 | 1.3 |
| E | 175 | 360 | 25 | 1720 | 200 | 1200 | 250 | — | 20 | 3 | 5 | 420 | 1.08 |
| F | 150 | 320 | 30 | 1730 | 250 | 1260 | 310 | — | — | 2 | 6 | 380 | 1 |
| G | 210 | 340 | 25 | 1230 | 260 | 1350 | 280 | | 350 | 2 | 5 | 360 | 1.11 |
| H | 150 | 320 | 25 | 1255 | 250 | 1360 | 260 | | 105 | 3 | 6 | 366 | 0.81 |

The wear resistance of the steels is measured by the loss of weight of a prismatic test piece which is rotated in a container containing graded quartzite aggregate for a period of 5 hours.

The wear resistance index Rus of a steel is the ratio of the wear resistance of the steel F, taken by way of reference, and the wear resistance of the steel in question.

The plates A to H are austenitized at 900° C.

After austenitization:

- the plate of steel A is cooled at a mean rate of 0.7° C./s above temperature T defined above (approximately 460° C.) and at a mean rate of 0.13° C./s therebelow, in accordance with the invention;
- the plates of steel B, C, D are cooled at a mean rate of 6° C./s above temperature T defined above (approximately 470° C.) and at a mean rate of 1.4° C./s therebelow, in accordance with the invention;
- the plates of steel E, F, G and H which are given by way of comparison, were cooled at a mean rate of 20° C./s above temperature T defined above and at a mean rate of 12° C./s therebelow.

The plates A to D have an auto-tempered martensitic/bainitic structure which contains approximately 10% of retained austenite, as well as titanium carbides, whereas the plates E to G have a completely martensitic structure, the plates G and H also containing coarse titanium carbides.

It can be seen that, although the plates A, B, C and D have levels of hardness which are lower than those of the plates E and F, they have significantly higher levels of resistance to abrasion. The lowest levels of hardness, which correspond, for the most part, to the lowest contents of free carbon, lead to better suitability for use.

Comparison of the examples C, D, F, G and H indicates that the increase in the abrasion resistance does not result simply from the addition of titanium, but instead from the combination of the addition of titanium and the structure containing residual austenite. It has been found that the steels F, G and H whose structure does not comprise any residual austenite have quite comparable levels of abrasion resistance, whereas steels C and D which contain residual austenite have substantially better levels of abrasion resistance.

Furthermore, comparison of the pairs G and H on the one hand and C and D on the other hand indicates that the presence of residual austenite substantially increases the effectiveness of the titanium. In the case of examples C and D, the increase from 0.110% to 0.350% of titanium becomes evident as an increase in the abrasion resistance of 56%, whereas for steels G and H, the increase is only 37%.

That observation can be attributed to the increased squeezing effect of the titanium carbides by the surrounding matrix when it contains residual austenite which can be transformed into hard martensite which expands during operation.

Furthermore, the deformation after cooling, without planishing, for the steel plates A or B is 6 mm/m and 17 mm/m for the steel plates E and F. These results indicate the reduction of deformation of the products obtained by means of the invention.

The result in practice, in accordance with the extent of surface evenness required by the users, is:

either the products can be supplied without planishing (saving in terms of cost and residual stresses), or planishing may be carried out in order to comply with stricter requirements in terms of surface evenness (for example, 5 mm/m), but more readily and with fewer stresses being introduced owing to the lesser original deformation of the products according to the invention.

The invention claimed is:

1. A resistant to abrasion plate made of steel whose chemical composition comprises, by weight:

$0.1\% \leqq C < 0.23\%$ $0\% \leqq Si \leqq 2\%$ $0\% \leqq Al \leqq 2\%$ $0.5\% \leqq Si+Al \leqq 2\%$ $0\% \leqq Mn \leqq 2.5\%$ $0\% \leqq Ni \leqq 5\%$ $0\% \leqq Cr \leqq 5\%$ $0\% \leqq Mo \leqq 1\%$ $0\% \leqq W \leqq 2\%$ $0.05\% \leqq Mo+W/2 \leqq 1\%$ $0\% \leqq B \leqq 0.02\%$ $0\% \leqq Ti \leqq 0.67\%$ $0\% \leqq Zr \leqq 1.34\%$ $0.05\% \leqq Ti+Zr/2 \leqq 0.67\%$ $0\% \leqq S \leqq 0.005\%$ $N < 0.03\%$ optionally from 0% to 1.5% of copper, optionally at least one element selected from Nb, Ta and V at contents such that $Nb/2+Ta/4+V \leqq 0.5\%$, the balance being iron and impurities resulting from the production operation, the chemical composition further complying with the following relationships:

$$C-Ti/4-Zr/8+7\times N/8 \geqq 0.095\%$$

and:

$$Ti+Zr/2-7\times N/2 > 0.05\%$$

and $$1.05\times Mn+0.54\times Ni+0.50\times Cr+0.3\times (Mo+W/2)^{1/2}+K > 1.8$$

with: $K=1$ if $B \geqq 0.0005\%$ and $K=0$ if $B < 0.0005\%$, the steel having a martensitic or martensitic/bainitic structure, the structure containing coarse titanium carbides and optionally coarse niobium and/or coarse vanadium carbides, and from 5% to 20% of retained austenite.

2. The resistant to abrasion plate according to claim 1, characterized in that:

$$1.05\times Mn+0.54\times Ni+0.50\times Cr+0.3\times (Mo+W/2)^{1/2}+K > 2.$$

3. The resistant to abrasion plate according to claim 1, wherein:

$$C \leqq 0.22\%$$

and:

$$C-Ti/4-Zr/8+7\times N/8 \geqq 0.12\%.$$

4. The resistant to abrasion plate according to claim 1, wherein:

$$Ti+Zr/2 \geqq 0.10\%.$$

5. The resistant to abrasion plate according to claim 1, wherein:

$$Si+Al \geqq 0.7\%.$$

6. The resistant to abrasion plate according to claim 1, wherein the thickness of the plate is from 2 mm to 150 mm.

* * * * *